US009170518B2

(12) United States Patent
DiRubio et al.

(10) Patent No.: US 9,170,518 B2
(45) Date of Patent: Oct. 27, 2015

(54) METHOD AND SYSTEM FOR CLOSED-LOOP CONTROL OF NIP WIDTH AND IMAGE TRANSFER FIELD UNIFORMITY FOR AN IMAGE TRANSFER SYSTEM

(75) Inventors: Christopher A. DiRubio, Webster, NY (US); Charles H. Tabb, Penfield, NY (US); Michael A. Fayette, Penfield, NY (US); John S. Facci, Webster, NY (US); Paul F. Sawicki, Rochester, NY (US); Thomas C. Keyes, Fairport, NY (US); Edward W. Schnepf, Ontario, NY (US); William R. Klimley, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 4 days.

(21) Appl. No.: 13/447,889

(22) Filed: Apr. 16, 2012

(65) Prior Publication Data

US 2013/0272735 A1 Oct. 17, 2013

(51) Int. Cl.
*G03G 15/16* (2006.01)
*G03G 15/01* (2006.01)

(52) U.S. Cl.
CPC ..... *G03G 15/0189* (2013.01); *G03G 15/161* (2013.01); *G03G 15/1675* (2013.01)

(58) Field of Classification Search
USPC ..... 399/66, 38, 71, 149, 299
See application file for complete search history.

(56) References Cited

U.S. PATENT DOCUMENTS

| | | | | |
|---|---|---|---|---|
| 2,912,586 | A | 11/1959 | Gundlach | |
| 3,781,105 | A | 12/1973 | Meagher | |
| 4,851,960 | A | 7/1989 | Nakamura et al. | |
| 5,164,779 | A | 11/1992 | Araya et al. | |
| 5,321,476 | A | 6/1994 | Gross | |
| 5,420,677 | A | 5/1995 | Gross et al. | |
| 5,613,173 | A | 3/1997 | Kunzmann et al. | |
| 5,697,015 | A * | 12/1997 | Ream et al. | 399/66 |
| 5,799,232 | A * | 8/1998 | Tompkins et al. | 399/167 |
| 5,849,399 | A | 12/1998 | Law et al. | |
| 6,411,792 | B2 * | 6/2002 | Hirai | 399/299 |
| 6,600,895 | B2 | 7/2003 | Fletcher et al. | |
| 6,606,477 | B2 | 8/2003 | Thompson et al. | |
| 6,611,665 | B2 | 8/2003 | DiRubio et al. | |
| 7,177,572 | B2 | 2/2007 | DiRubio et al. | |
| 7,512,367 | B2 | 3/2009 | Parks | |
| 2003/0133729 | A1 | 7/2003 | Thompson et al. | |
| 2008/0152369 | A1 | 6/2008 | DiRubio et al. | |
| 2008/0152371 | A1 | 6/2008 | Burry et al. | |
| 2009/0180790 | A1 * | 7/2009 | Gross et al. | 399/66 |
| 2009/0304408 | A1 | 12/2009 | DiRubio et al. | |
| 2010/0067960 | A1 | 3/2010 | Jackson | |
| 2011/0150514 | A1 * | 6/2011 | Falvo et al. | 399/66 |
| 2012/0051801 | A1 | 3/2012 | Tabb et al. | |
| 2012/0051803 | A1 | 3/2012 | DiRubio et al. | |

FOREIGN PATENT DOCUMENTS

| | | | |
|---|---|---|---|
| JP | 59097168 | A * | 6/1984 |
| JP | 2003280409 | A * | 10/2003 |

OTHER PUBLICATIONS

U.S. Appl. No. 12/945,942, filed Nov. 15, 2010, DiRubio et al.

* cited by examiner

*Primary Examiner* — Quana M Grainger
(74) *Attorney, Agent, or Firm* — Fay Sharpe LLP

(57) ABSTRACT

Disclosed is a closed-loop control method and system to control the nip width and transfer field uniformity associated with an image marking apparatus. According to an exemplary embodiment, a closed-loop control system senses the uniformity of the image transfer field and applies forces to a transfer nip based on the sensed field to provide a more uniform field.

26 Claims, 10 Drawing Sheets

METHOD AND SYSTEM FOR CLOSED-LOOP CONTROL OF NIP WIDTH AND IMAGE TRANSFER FIELD UNIFORMITY FOR AN IMAGE TRANSFER SYSTEM

CROSS REFERENCE TO RELATED PATENTS AND APPLICATIONS

U.S. patent application Ser. No. 12/945,942, filed Nov. 15, 2010, entitled "TESTING TRANSFER NIPS OF PRINTING DEVICES USING TRANSFER FIELD UNIFORMITY MAPS," by DiRubio et al.; and U.S. patent application Ser. No. 12/868,936, filed Aug. 26, 2010, entitled "IMAGE TRANSFER ROLLER (ITR) UTILIZING AN ELASTOMER CROWN," by DiRubio et al., are incorporated herein by reference in their entirety.

BACKGROUND

The present exemplary embodiments relate to document processing systems such as printers, copiers, multi-function devices, etc., and operating methods for mitigating retransfer associated with the transfer of toner from a first substrate to a second substrate. Examples of the failure modes associated with retransfer include, but are not limited to, image noise, image mottle, deletions, color shifts, poor color macro-uniformity, poor color stability, and cross color developer contamination. Multi-color toner-based Xerographic printing systems typically employ two or more xerographic marking devices to individually transfer toner of a given color to an intermediate image transfer medium, such as a drum or belt, with the toner being subsequently transferred from the intermediate medium to a sheet or other final print medium, after which the twice transferred toner is fused to the final print. Retransfer occurs when toner on the intermediate image transfer belt from previous, upstream marking devices is wholly or partially removed (scavenged) due to high fields within the transfer nip. High fields in the transfer nips in the previous downstream marking devices can adversely modify the charge state of the toner on the intermediate image transfer medium, such as an intermediate image transfer belt (ITB), through air breakdown mechanisms, further exacerbating retransfer. When this happens, the desired amount of one or more toner colors is not transferred to the final printed sheet, and the retransfer problem worsens as the number of colors increases. Retransfer at a given marking device may be reduced by lowering the transfer field strength at that device, but this may lead to incomplete transfer during image building at that device. In other words, the transfer nip may be transferring toner to the intermediate ITB at one region in the cross-process direction (image building), which requires high fields, while simultaneously scavenging toner from the intermediate ITB in another region (retransfer). In addition, the quality requirements of multi-color document processing systems are constantly increasing, with customers demanding the improved imaging capabilities without the adverse effects of retransfer and incomplete transfer. Accordingly, a need remains for improved multi-color document processing systems and an improved transfer mechanism design through which retransfer and the aforementioned problems can be mitigated.

INCORPORATION BY REFERENCE

U.S. patent application Ser. No. 12/868,977, filed Aug. 26, 2010, entitled "IMAGE TRANSFER NIP METHOD AND APPARATUS USING CONSTANT CURRENT CONTROLS," by Tabb et al.;

U.S. Patent Application Publication No. 2003/0133729 to Thompson et al., entitled "METHOD TO CONTROL PRE- AND POST-NIP FIELDS FOR TRANSFER," published Jul. 17, 2003;

U.S. Patent Application Publication No. 2008/0152371 to Burry et al., entitled "PHOTOCONDUCTOR LIFE THROUGH ACTIVE CONTROL OF CHARGER SETTINGS," published Jun. 26, 2008;

U.S. Patent Application Publication No. 2008/0152369 to DiRubio et al., entitled "METHOD OF USING BIASED CHARGING/TRANSFER ROLLER AS IN-SITU VOLTMETER AND PHOTORECEPTOR THICKNESS DETECTOR AND METHOD OF ADJUSTING XEROGRAPHIC PROCESS WITH RESULTS," published Jun. 26, 2008;

U.S. Patent Application Publication No. 2009/0304408 to DiRubio et al., entitled "MULTI-COLOR PRINTING SYSTEM AND METHOD FOR HIGH TONER PILE HEIGHT PRINTING," published Dec. 10, 2009;

U.S. Patent Publication No. 2010/0067960 to Jackson, entitled "HYBRID PRINTING SYSTEM," published Mar. 18, 2010;

U.S. Pat. No. 2,912,586 to Gundlach, entitled "XEROGRAPHIC CHARGING," issued Nov. 10, 1959;

U.S. Pat. No. 3,781,105 to Meagher, entitled "CONSTANT CURRENT BIASING TRANSFER SYSTEM," issued Dec. 25, 1973;

U.S. Pat. No. 4,851,960 to Nakamura et al., entitled "CHARGING DEVICE," issued Jul. 25, 1989;

U.S. Pat. No. 5,164,779 to Araya et al., entitled "IMAGE FORMING APPARATUS WITH DUAL VOLTAGE SUPPLIES FOR SELECTIVELY CHARGING AND DISCHARGING AN IMAGE BEARING MEMBER," issued Nov. 17, 1992;

U.S. Pat. No. 5,321,476 to Gross, entitled "HEATED BIAS TRANSFER ROLL," issued Jun. 14, 1994;

U.S. Pat. No. 5,420,677 to Gross et al., entitled "METHOD AND APPARATUS FOR EXTENDING MATERIAL LIFE IN A BIAS TRANSFER ROLL," issued May 30, 1995;

U.S. Pat. No. 5,613,173 to Kunzmann et al., entitled "BIASED ROLL CHARGING APPARATUS HAVING CLIPPED AC INPUT VOLTAGE," issued Mar. 18, 1997;

U.S. Pat. No. 5,849,399 to Law et al., entitled "BIAS TRANSFER MEMBERS WITH FLUORINATED CARBON FILLED FLUOROELASTOMER OUTER LAYER," issued Dec. 15, 1998;

U.S. Pat. No. 6,600,895 to Fletcher et al., entitled "PRINTING MACHINE AND METHOD USING A BIAS TRANSFER ROLLER INCLUDING AT LEAST ONE TEMPERATURE-MAINTAINING DEVICE," issued Jul. 29, 2003;

U.S. Pat. No. 6,606,477 to Thompson et al., entitled "METHOD TO CONTROL PRE- AND POST-NIP FIELDS FOR TRANSFER," issued Aug. 12, 2003;

U.S. Pat. No. 6,611,665 to DiRubio et al., entitled "METHOD AND APPARATUS USING A BIASED TRANSFER ROLL AS A DYNAMIC ELECTROSTATIC VOLTMETER FOR SYSTEM DIAGNOSTICS AND CLOSED LOOP PROCESS CONTROLS," issued Aug. 26, 2003;

U.S. Pat. No. 7,177,572 to DiRubio et al., entitled "BIASED CHARGE ROLLER WITH EMBEDDED ELECTRODES WITH POST-NIP BREAKDOWN TO ENABLE IMPROVED CHARGE UNIFORMITY," issued Feb. 13, 2007;

U.S. Pat. No. 7,512,367 to Parks, entitled "ULTRASONIC BACKER FOR BIAS TRANSFER SYSTEMS," issued Mar. 31, 2009; are all incorporated herein by reference in their entirety.

BRIEF DESCRIPTION

In one embodiment of this disclosure, described is a method of marking an image on a substrate using an image transfer printing apparatus including a photoreceptor surface; an exposure station operatively associated with the photoreceptor surface; a developer system operatively associated with the photoreceptor surface; and a substrate; an image transfer nip operatively associated with transferring an image from the photoreceptor surface to the substrate, the method comprising a) forming an electrostatic image on the photoreceptor surface representative of the image to be marked on the substrate using the exposure system; b) developing the electrostatic image on the photoreceptor surface with toner material using the developer system to generate a developed image; and c) transferring the developed image from the photoreceptor surface to the substrate by electrically biasing the image transfer nip to generate an image transfer field across the image transfer nip and applying one or more forces to the image transfer nip to control a spatial uniformity associated with the image transfer nip, the one or more forces determined by executing a closed-loop control system to determine the one or more forces for generating a substantially uniform image transfer field across the image transfer nip, the closed-loop control system configured to sense the uniformity of the image transfer field, and determine the one or more forces based on the sensed uniformity of the image transfer field.

In another embodiment of this disclosure, described is an image marking apparatus comprising a substrate; an image marking device operatively associated with transferring of an image to the substrate, the image marking device associated with a distinct toner material colorant; and an image transfer nip operatively associated with transferring an image to the substrate, the image transfer nip configured to transfer the image to the substrate by electrically biasing the image transfer nip to generate an image transfer field across the image transfer nip and applying one or more forces to the image transfer nip to control a spatial uniformity associated with the image transfer nip, the one or more forces determined by executing a closed-loop control system to determine the one or more forces for generating a substantially uniform image transfer field across the image transfer nip, the closed-loop control system configured to sense the uniformity of the image transfer field, and determine the one or more forces based on the sensed uniformity of the image transfer field.

In still another embodiment of this disclosure, described is an image marking apparatus comprising an intermediate image transfer belt; an image marking device operatively associated with transferring of an image to the intermediate image transfer belt, the image marking device associated with a distinct toner material colorant; an image transfer nip operatively associated with transferring an image to the intermediate image transfer belt, the image transfer nip configured to transfer the image to the intermediate image transfer belt by electrically biasing the image transfer nip to generate an image transfer field across the image transfer nip and applying one or more forces to the image transfer nip to control a spatial uniformity associated with the image transfer nip, the one or more forces determined by executing a closed-loop control system to determine the one or more forces for generating a substantially uniform image transfer field across the image transfer nip, the closed-loop control system configured to sense the uniformity of the image transfer field, and determine the one or more forces based on the sensed uniformity of the image transfer field; and an image transfer station operatively associated with the transfer of the image from the intermediate image transfer belt to the media substrate.

In yet another embodiment of this disclosure, described is an image marking apparatus comprising an intermediate transfer belt; an image marking device operatively associated with transferring of an image to the intermediate image transfer belt, the image marking device associated with a distinct toner material colorant; and an image transfer station operatively associated with the transfer of the image from the intermediate image transfer belt to the media substrate, the image transfer station including an image transfer nip configured to transfer the image from the intermediate image transfer belt by electrically biasing the image transfer nip to generate an image transfer field across the image transfer nip and applying one or more forces to the image transfer nip to control a spatial uniformity associated with the image transfer nip, the one or more forces determined by executing a closed-loop control system to determine the one or more forces for generating a substantially uniform image transfer field across the image transfer nip, the closed-loop control system configured to sense the uniformity of the image transfer field, and determine the one or more forces based on the sensed uniformity of the image transfer field.

DETAILED DESCRIPTION

As briefly discussed in the Background section, a tandem intermediate belt marking architecture builds an image using transfer nips one separation at a time on an intermediate transfer belt (ITB). Non-uniform transfer nip widths in the cross-process direction lead to non-uniform transfer fields, which cause objectionable print quality defects like cross-process color or optical density shifts (poor macro-uniformity), and cross-process variation in mottle. These defects, some of which are caused by retransfer scavenging, can be particularly severe if the architecture contains more than four separations (colors). For example, there exist six color (yellow, magenta, cyan, black, and two other color) printing architectures which provide advantages such as improved color gamut and superior image smoothness for photo applications. The transfer field is generated by applying high voltage to a biased image transfer roll (BTR) that consists of a conformable elastomer surrounding a metal shaft, for example, as disclosed in U.S. patent application Ser. No. 12/868,936 by DiRubio et al. The mechanical pressure uniformity within the contact nip is determined by a durometer (or Young's modulus) of the elastomer, the crown of the elastomer, and the force applied to the BTR shaft. A major driver of nip width variation is the wide manufacturing tolerance on the crown of the elastomer.

Disclosed here is a closed-loop control strategy to insure that each transfer nip has a uniform nip width in the cross process direction. Non-uniform nip widths lead to non-uniform transfer fields. According to one exemplary embodiment, the transfer field uniformity is sensed using a Transfer Field Uniformity Map (TFUM) such as that disclosed in U.S. patent application Ser. No. 12/945,942 by DiRubio et al. The TFUM is generated by running the high voltage transfer bias at a much lower level than normal, where the transfer efficiency, and therefore the print optical density and transferred mass per unit area (TMA), is much more sensitive to variations in the spatial uniformity of the transfer field. Cross process variations in the Area Density Coverage (ADC) or Extended Area Coverage (ETAC) sensors can then be sensed by an array of several point TMA sensors, e.g., or sensed by a higher resolution Full Width Array scan bar (FWA). The nip force applied to each end of the shaft of the image transfer roller can then be actuated until the TFUM, and therefore the nip widths, are spatially uniform across the process. This closed-loop control strategy is used to insure that all of the transfer nips have a uniform nip width, thereby insuring uniform print quality across the process/print.

Figure 1:
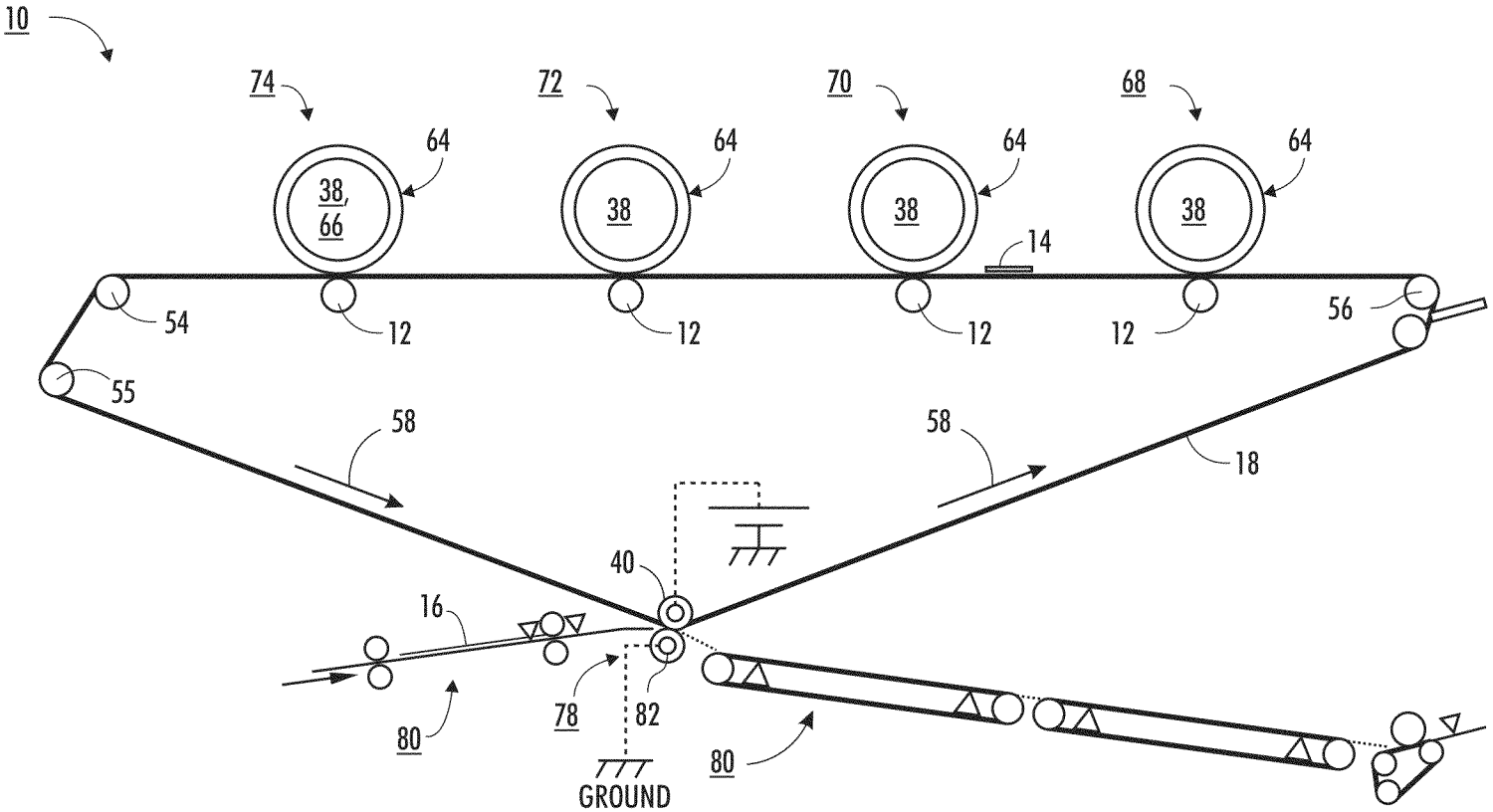
FIG. 1 is a schematic of a xerographic printer implementing one exemplary embodiment of a four color tandem ITB (Intermediate Transfer Belt) marking engine employing image transfer rolls (NOTE: ITRs, when electrically biased are also known as biased transfer rolls [BTRs]) according to this disclosure.

Referring to FIG. 1, there is shown a schematic view of a xerographic printer 10, such as a copier or laser printer, incorporating features of the present disclosure. Although the present disclosure will be described with reference to the embodiment shown in the drawings, it should be understood that the present disclosure can be embodied in many alternate forms of embodiments. In addition, any suitable size, shape or type of elements or materials could be used.

With reference to FIG. 1, illustrated is xerographic printer 10 which includes at least one biased first image transfer roll 12. Many xerographic printers 10 use at least one biased first image transfer roll 12 for transferring imaged toner 14 to a sheet-type substrate 16 or an intermediate image transfer belt 18 as shown in FIG. 1. While transferring imaged toner 14 initially to an intermediate image transfer belt and subsequently to a sheet type substrate has been shown and described, the present disclosure is not so limited, as image transfer rolls can also be used to transfer to continuous rolls of paper, without departing from the broader aspects of the present disclosure. Some high volume xerographic printers 10 may have five or more biased image transfer rolls 12, while many low volume xerographic printers 10 have at least one biased image transfer roll 12.

U.S. Pat. No. 3,781,105 discloses some examples of a biased image transfer roll used in a xerographic printer. Some of the details disclosed therein may be of interest as to teachings of alternatives to details of the embodiment herein.

Figure 2:
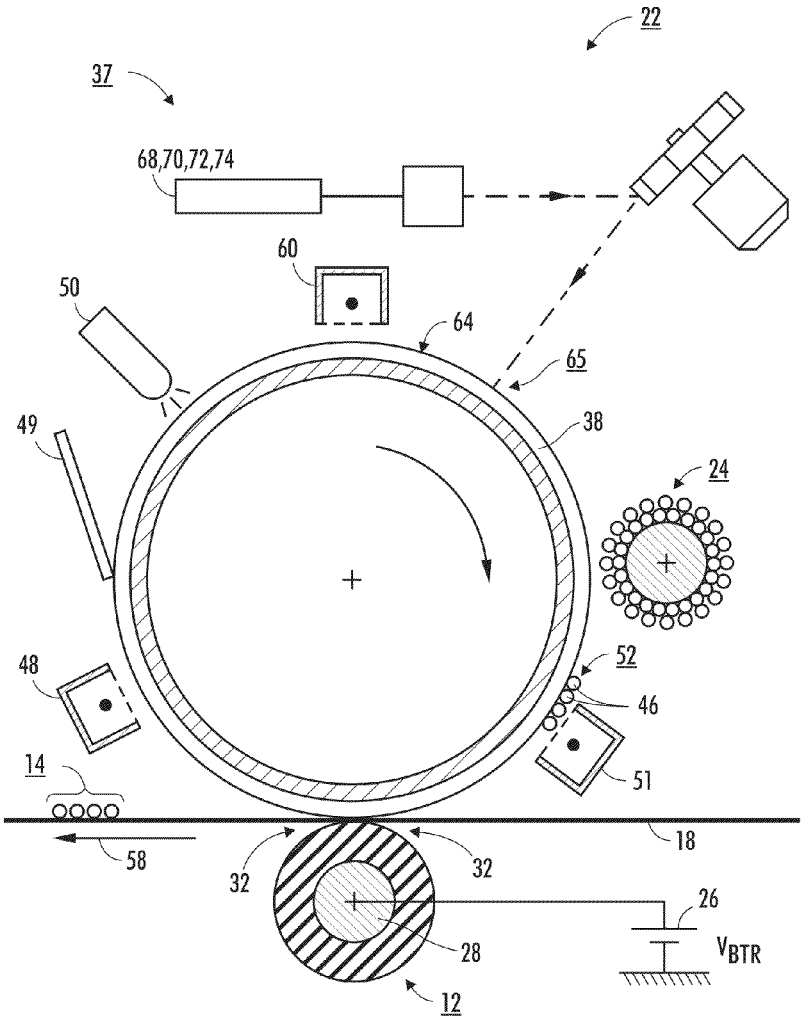
FIG. 2 is a schematic of one exemplary embodiment of a xerographic station incorporating an image transfer roll according to this disclosure.

Referring now to FIG. 2, the biased first image transfer roll 12 is generally operated in a constant current mode, in which a high voltage power supply 26 varies a voltage ($V_{BTR}$) applied to a steel shaft 28 of the biased image transfer roll 12 to maintain a constant current. In one embodiment, changes in the level of voltage of the biased image transfer roll 12 can be used to indicate a change in the electric field in air gaps leading to and from each nip, which is the contact or almost contact area having small or zero air gaps between the biased image transfer roll 12 and, for example, a photoconductor drum 38. A nip region 32 generally includes the air gaps upstream of the nip (pre-nip region), and the air gaps downstream of the nip (post-nip region). The biased image transfer roll 12 can function in a dynamic mode where the components, such as photoreceptor, belts and toner, are moving through the nip region 32.

Notably, the electric field of the biased image transfer roll 12 in the nip region 32 can be affected by an electrical field generated by components of the xerographic printer 10 passing through the nip region 32. The voltage (VITR) applied to the shaft 28 of the biased image transfer roll 12 shifts in response to changes in the operating properties of subsystems 22, and the electrical field and/or charge and/or thicknesses of the various components of the subsystems 22

Before describing the particular features of the present disclosure in detail, an exemplary xerographic printer 10 will be further described, which can be a black and white or multicolor copier or laser printer. To initiate the copying process, a multicolor original document is positioned on a raster input scanner (RIS) which captures the entire image from original document which is then transmitted to a raster output scanner (ROS) 37. The raster output scanner 37 illuminates a charged portion of a photoconductor 64 of a photoconductor drum (OPC) 38, or photoconductor drums 38, of a xerographic printer 10. While a photoconductor drum 38 has been shown and described, the present disclosure is not so limited, as the photoconductor surface 64 may be a type of belt or other structure, without departing from the broader aspects of the present disclosure. The raster output scanner 37 exposes each photoconductor drum 38 to record one of the four subtractive primary latent images.

Continuing with FIG. 2, one latent image is to be developed 24 with a cyan developer material, which is a type of toner 46. Another latent image is to be developed 24 with magenta developer material, a third latent image is to be developed 24 with yellow developer material, and a fourth latent image is to be developed 24 with black developer material, each on their respective photoconductor drums 38. These developed images 52 are charged with a pre-transfer subsystem 51 and sequentially transferred to an intermediate belt 18, and subsequently transferred to a copy sheet 16 in superimposed registration with one another to form a multicolored image on the copy sheet which is then fused thereto to form a color copy. The photoconductor drum 38 is cleaned after the transfer with the use of a pre-clean subsystem 48, a clean subsystem 49 and an erase lamp 50.

Referring again to FIG. 1, the xerographic printer 10 can include an intermediate image transfer belt 18 which is entrained about the first image transfer rolls 12, 2nd image transfer rolls 40 and 82, tensioning rollers 54, steering roller 55, and drive roller 56. As drive roller 56 rotates, it advances the intermediate image transfer belt 18 in the direction of arrow 58 to sequentially advance successive portions of the intermediate image transfer belt 18 through the various processing stations disposed about the path of movement thereof. The intermediate image transfer belt 18 usually advances continuously as the xerographic printer operates.

Referring to FIG. 2, initially, a portion of each of the photoconductor drums 38 passes through a charging station 60. At the charging station 60, a corona generating device or other charging device generates a high voltage to charge the photoconductive surface 64 of each photoconductor drum 38 to a relatively high, substantially uniform voltage potential (Vopc).

As shown in FIG. 2, each charged photoconductor drum 38 is rotated to an exposure station 65. Each exposure station 65 receives a modulated light beam corresponding to information derived by raster input scanner having a multicolored original document positioned thereat. Alternatively, in a laser printing application the exposure may be determined by the content of a digital document. The modulated light beam impinges on the surface 64 of each photoconductor drum 38, selectively illuminating the charged surface 64 to form an electrostatic latent image thereon. The photoconductive surface 64 of each photoconductor drum 38 records one of three latent images representing each color. The fourth photoconductive drum 66 is used for either color or black and white documents.

After the electrostatic latent images have been recorded on each photoconductor drum 38, the intermediate image transfer belt 18 is advanced toward each of four xerographic stations indicated by reference numerals 68, 70, 72 and 74. The full color image is assembled on the intermediate image transfer belt 18 in four first transfer steps, one for each of the primary toner colors. Xerographic stations 68, 70, 72, 74 respectively, apply toner particles of a specific color on the photoconductive surface 64 of each photoconductor drum 38.

Referring again to FIG. 2, as the intermediate image transfer belt 18 passes by each xerographic station 68, 70, 72, 74, the respective photoconductor drum 38 rotates with the movement of the intermediate image transfer belt 18 to synchronize the movement of the toner image 14 laid down on the intermediate image transfer belt 18 by the previous xerographic station(s) 68, 70, 72, with the rotation of the toner 52 on each photoconductor drum 38. Each developed image 52 recorded on each of the photoconductive surfaces 64 of each photoconductor drum 38 is transferred, in superimposed registration with one another, to the intermediate image transfer belt 18 for forming the multi-color copy 14 of the colored original document.

Continuing with FIG. 2, the convergence of the biased image transfer roll 12 and each photoconductor drum 38 form the nip 32 in which the toner particles 52 from the photoconductor surface 64 and the intermediate image transfer belt 18 enter synchronously. The biased image transfer roll 12 causes the toner image 52 on the photoconductor drum 38 to transfer to the intermediate image transfer belt 18, and merge with any toner particles 14 previously transferred to the intermediate image transfer belt 18. As the transfer begins, the surface 64 of the photoconductor drum 38, the intermediate image transfer belt 18, and any toner 14, 52 present on either, enter the air gaps associated with nip region 32.

Referring to FIG. 1 and FIG. 2, after development 24 and subsequent transfer of each color to the Intermediate image transfer belt 18, the toner image 14 is moved to a transfer station 78 which defines the position at which the toner image 14 is transferred to a sheet of support material 16, which may be a sheet of plain paper or any other suitable support substrate. A sheet transport apparatus 80 moves the sheet 16 into contact with intermediate image transfer belt 18. During sheet transport, the sheet 16 is moved into contact with the intermediate image transfer belt 18, in synchronism with the toner image 14 developed thereon.

As shown in FIG. 1, the toner image 14 on the intermediate image transfer belt 18 is transferred, in superimposed registration with one another, to the sheet for forming the multicolor copy of the colored original document. The backup roll 40 together with a second biased image transfer roll 82 transfer the toner image 14 to the sheet-type substrate 16. Conventionally, a high voltage is applied to the surface of the backup roller 40 using a steel roller. The image transfer roll 82 shaft is grounded. This creates an electric field that pulls the toner 14 from the intermediate image transfer belt 18 to the substrate 16.

The sheet transport system 80 directs the sheet for transport to a fusing station and removal to a catch tray. Each photoconductor drum 38 also includes a cleaning station including a pre-clean subsystem 48, and a clean subsystem 49 for removing residual toner. An erase lamp subsystem 50 removes residual charge.

The foregoing description should be sufficient for purposes of the present application for patent to illustrate the general operation of a xerographic printer 10 incorporating the features of the present disclosure. As described, a xerographic printer 10 may take the form of any of several well-known devices or systems. Variations of specific xerographic processing subsystems 22 or processes may be expected without affecting the operation of the present disclosure.

As previously discussed, the first transfer ITRs in Tandem Intermediate Belt transfer print engines can be crowned to help mitigate both a cross-process color macro-uniformity defect known as retransfer smile, and a cross-process variation in the severity of image mottle. In some cases, however, the ITR elastomer has a non-optimal trapezoidal crown profile due to poor crown design. As a result, the retransfer smile defect is observed in the field which can result in service calls and an increase in overall run cost.

Figure 3:
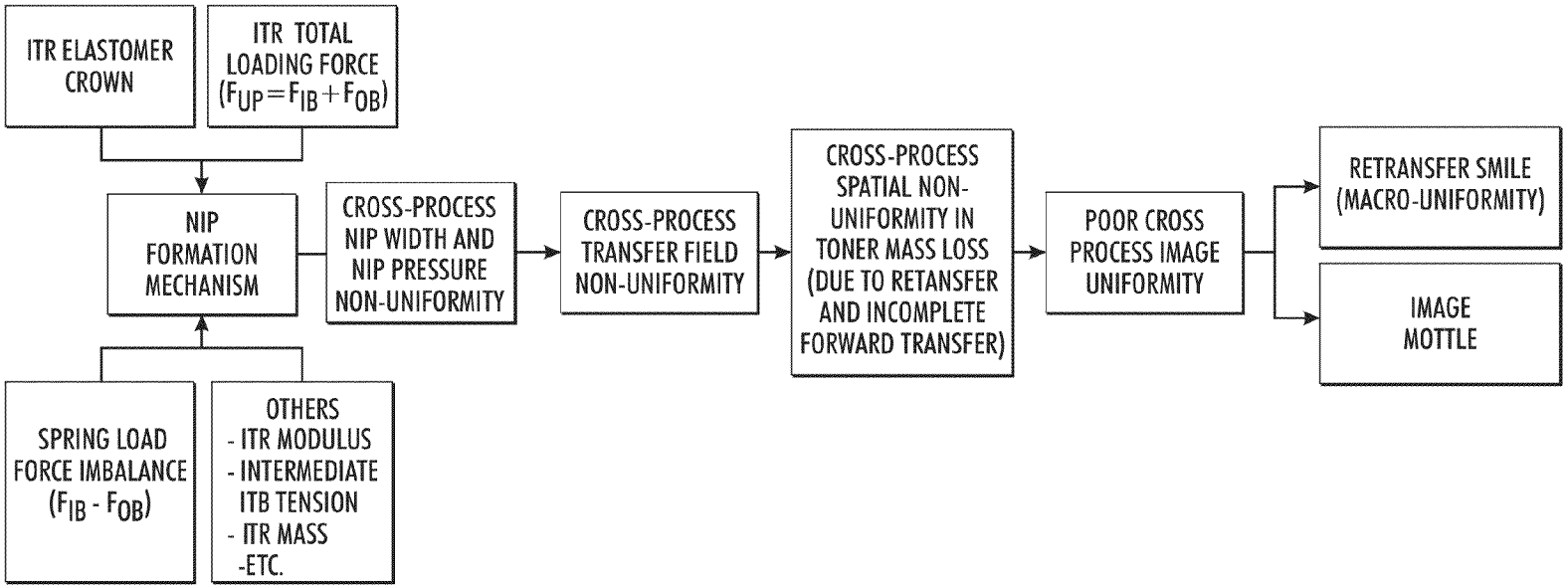
FIG. 3 illustrates the relationships among nip mechanics, the ITR elastomer crown and the retransfer defect known as macro-uniformity smile.

FIG. 3 details various factors which can contribute to transfer field uniformity which in turn contributes to retransfer smile and image mottle.

Described now is a closed-loop control system to insure uniform transfer fields across the process in all of the image transfer nips in a marking engine using conformable biased transfer devices like Biased Transfer Rollers (BTRs) or Biased Transfer Belts (BTBs). While this approach may be useful in any xerographic marking engine, it may be particularly advantageous in tandem IBT engines that could contain up to 7 (e.g. 6-color printing engine) or more transfer nips.

A control loop directly senses the transfer field uniformity in the cross process direction, and actuates a mechanical force on an image transfer device that brings the image receiving member (e.g. the intermediate transfer belt) into contact with the image bearing member (e.g. the photoreceptor). By keeping the transfer field uniformity below the target value selected for the control loop, the system insures a relatively higher print quality across the process.

Figure 4:
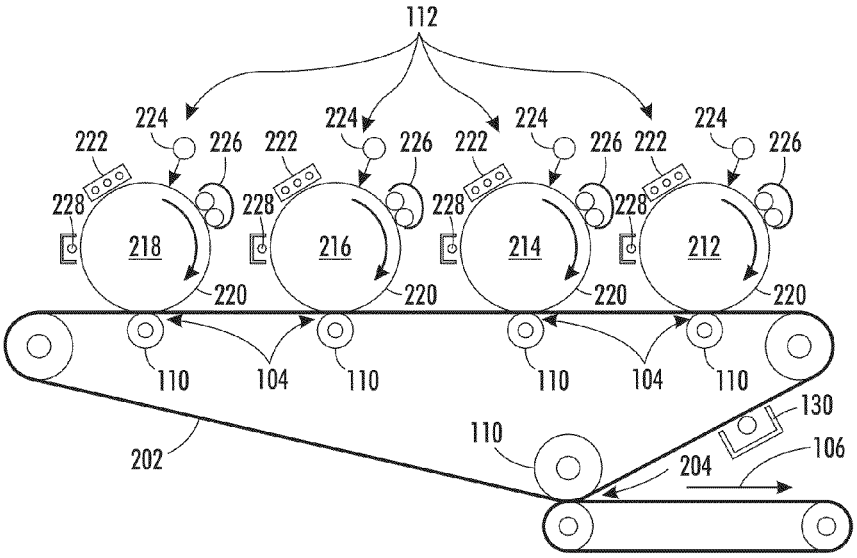
FIG. 4 is a schematic representation of a four color tandem ITB (Intermediate Transfer Belt) marking engine according to an exemplary embodiment of this disclosure.

While the embodiments herein are applicable to any marking architecture, one example that can illustrate the embodiments herein is a tandem Intermediate Belt Transfer (IBT) architecture. An example of this architecture is illustrated in FIG. 4.

While the marking material transfer units 104, 204 are sometimes referred to herein as transfer "nips" formed between two rollers, as would be understood by those ordinarily skilled in the art, the marking material transfer units 104, 204 herein can comprise any device that transfers marking material from one surface to another, including mechanical devices, electrical devices, and electro-mechanical devices.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known by those ordinarily skilled in the art and are discussed in, for example, U.S. Patent Publication 2010/0067960, the complete disclosure of which is fully incorporated herein by reference. The embodiments herein can encompass embodiments that print in color, monochrome, or handle color or monochrome image data. All embodiments are specifically applicable to electrostatographic machines and/or processes.

A full process color image output terminal (IOT) assembly includes an intermediate transfer belt or image receiving and carrying member 202, and a series of components for forming and transferring full process color images onto the intermediate image receiving and carrying member 202. The print engines 112 include drum-based YMC image output terminals 212, 214, 216, and a K (black) image output terminal 218. The image output terminals 212, 214, 216, 218 form the full process color image on the intermediate transfer belt 202. Each image output terminal 212 includes an image bearing member 220, a charging device 222, exposure device 224, development device 226, and cleaning device 228 for forming a separate toner image on the image bearing member 220 for transfer onto the intermediate transfer belt or image receiving and carrying member 202.

As shown in FIG. 4, an image is built on an intermediate transfer belt (ITB) 202 using four marking units 112. Each of the marking units 112 applies a different separation (e.g., color or tone (e.g., yellow, magenta, cyan, black (Y,M,C,K)) of marking material (ink, toner, etc.) to the transfer belt 202 using "first transfer" nips 104. Thus, one separation (e.g., color or tone) of marking material is applied to the belt 202 at a time. The 4-color image is then transferred from the belt 202 to a sheet of media 106 (e.g., paper, transparencies, etc.) that is traveling along the paper path by the second transfer nip 204. An intermediate transfer belt cleaner is shown as item 130.

Figure 5:
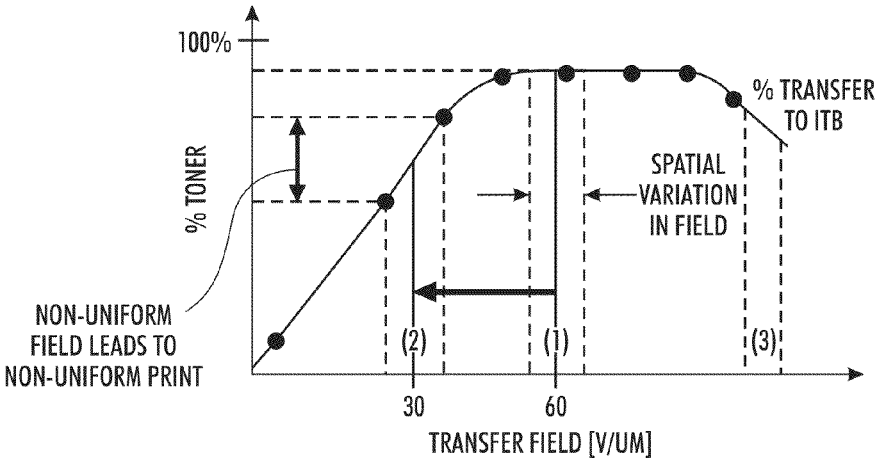
FIG. 5 is a plot of an image transfer field according to an exemplary embodiment of this disclosure.

The transfer field is usually generated by applying a high voltage bias to the shaft of the bias transfer roll (BTR) 110 located on the inside of the intermediate transfer belt, opposite the photoreceptor. The high voltage bias may be operated in either constant current mode or constant voltage mode, depending on the details of the design of the transfer nip. Therefore the transfer field is controlled indirectly by controlling either the voltage or the current supplied by the high voltage power supply. The fraction of the toner transferred from the developed image on the photoreceptor to the intermediate transfer belt is illustrated graphically by the "% transfer to ITB curve" in FIG. 5. As shown in FIG. 5, under normal operating fields at, for example 60 V/μm (spatial variation region (1)) the transfer efficiency (indicated by the dashed horizontal line) is very insensitive to spatial variation in the transfer field (variation indicated by dotted vertical lines).

A full-page single separation halftone print from the marking station is very spatially uniform at, for example, 60 V/μm. If, however, the transfer field is changed by adjusting the power supply to a voltage or current above or below the flat insensitive region (from spatial variation region (1) to spatial variation region (2), in FIG. 5) then the transfer efficiency, and therefore the toner density transferred to the intermediate transfer belt, is very sensitive to spatial variation in the transfer field. Likewise, if the transfer field is increased to a level above the spatially uniform region (for example to region 3 in FIG. 5), the toner density transferred to the belt will be very sensitive to spatial variation in the transfer field.

Thus, as shown in FIG. 5, at optimal transfer fields, potential spatial non-uniformities would not be easy to detect because the optimal fields keep the transfer image density uniform (flat region of the % transfer to ITB curve shown in FIG. 5). Thus, at optimal fields (e.g., 60 V/(im) a transfer field spatial variation within the transfer nip would result in very little change in the percentage of toner transferred, as shown by spatial variation region (1) of the % transfer to ITB curve in FIG. 5.

However, if the transfer field is changed to a point on the % transfer to ITB curve in FIG. 5 that is not flat (is sloped), potential spatial non-uniformities are much easier to detect. Thus, at different fields (e.g. 30 V/μm) a transfer field spatial variation within the transfer nip would result in a large change in the percentage of toner transferred (e.g., 10%, 25%, 50%, etc.) as shown by region (2) in FIG. 5 where the non-uniform field leads to non-uniform printing. The different fields therefore amplify any potential non-uniformities that may be produced by a given transfer nip, allowing users and/or sensors to more easily detect such differences in the amount of marking material transferred by the transfer nip. Likewise, the transfer field could be increased to the sloped region above ~80 V/μm to sense and amplify the spatial non-uniformities in the field.

A transfer field uniformity map (such as that shown in FIG. 6) can be generated for any of the transfer nips by changing the applied transfer field until the transfer device is operating in the sloped region of the % transfer to ITB curve (spatial variation region (2 or 3) in FIG. 5). The exemplary transfer field uniformity map 300 shown in FIG. 6 was made with a magenta transfer nip. A long edge feed (process direction top to bottom) full page halftone print (area coverage ~60%) was generated at a low transfer field and sensed at position T2 in FIG. 7.

The variation in the density of the print in the cross-process direction is due to lower fields in the center of the transfer nip relative to the inboard and outboard edges. The bias transfer roll 110 nip width variation leads to transfer field variation in the cross process direction. For example, with a wide nip, the higher transfer fields produce darker images 302 near the inboard and outboard edges. However, a narrow nip leads to lower transfer fields and a lighter image 304 in the center. This field variation can lead to the color shifts in the cross process direction during normal printing operation that are due to spatially non-uniform retransfer scavenging to downstream first transfer nips. This is particularly noticeable when printing multi-color images. For example, consider the case of a red image. In the first two transfer nips yellow and then magenta toner are transferred to the intermediate transfer belt (ITB). This transfer will be spatially uniform (optimal region of FIG. 5). In the two downstream nips (cyan and black) no additional toner is transferred to the red image element, but magenta toner from the top of the red image can be scavenged from the ITB and retransferred to the photoreceptor. The scavenged magenta toner results in a color shift of the red image element. If the transfer fields are spatially non-uniform in the cyan and black nips, then more magenta toner will be scavenged from the high field regions (say the inboard and outboard edges) than the low field regions, and therefore there will be a variation of the color of a red image element depending on where it is located in the page. This defect is sometimes referred to as "retransfer smile". The higher fields (for example in the inboard and outboard edge) result in more air breakdown in the toner pile, which creates wrong sign, positively charged toner near the top of the pile. This wrong sign toner is pulled towards the photoreceptor, leading to enhanced retransfer scavenging.

Field variation in the process direction that repeats at a distance equal to the circumference of the biased transfer roller 306 indicates non-uniformity in the electrical or mechanical properties of the bias transfer roll 110. Several low field defects in the sample transfer field uniformity map 300 repeat at this spatial frequency.

The embodiments herein also measure and evaluate the spatial uniformity of the density of the marking material (image) transferred to the substrate. Here, the substrate could be the intermediate transfer belt 202 (to evaluate first transfer) and/or a sheet of media 106 (to evaluate first and/or second transfer). The amount of marking material transferred to the substrate is sometimes referred to herein as the transfer image density (TMA) (transferred mass per unit area).

There are several sensor options for sensing transfer field uniformity maps (TFUMs). Full width array (FWA) imaging bars would provide data that could be used to find spatially small transfer field variations such as the repetitive point defects 306 illustrated in FIG. 6. A less expensive array of point sensors located at different points in the cross-process direction could be used to detect larger scale cross-process field variation, like that expected from retransfer smile 306 (see FIG. 6). The retransfer smile defect (color variation in the cross-process direction) is caused by cross-process transfer field variation. Point image/toner density sensors are already routinely used in color engines to monitor the TMA (transferred mass per unit Area) at position TI in FIG. 7. These sensors include the ETACS (Enhanced Toner Area Coverage Sensors) available from, for example, Xerox Corporation, Norwalk, Conn., USA.

Figure 7:
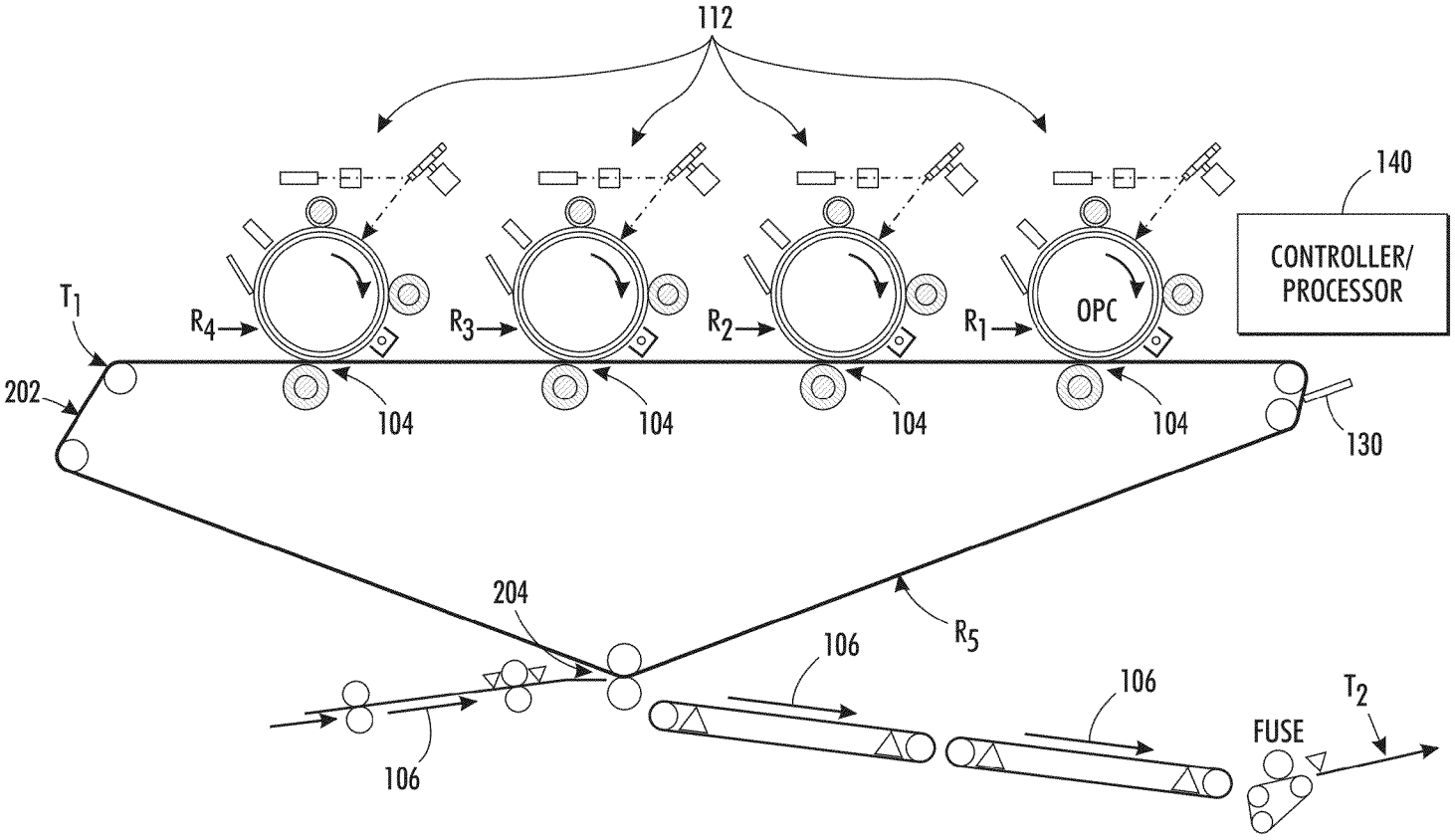
FIG. 7 is a schematic representation of a four color tandem ITB (Intermediate Transfer Belt) marking engine according to an exemplary embodiment of this disclosure.

The embodiments herein evaluate the density of the toner remaining on the image bearing member (photoreceptor, transfer belt, media sheet, etc.)

using various sensors. FIG. 7 illustrates some exemplary transfer sensors TI and T2. The embodiments herein can measure the amount of marking material that has been transferred to the image bearing members, using transfer sensors TI and T2, or can measure the amount of marking material remaining on the photoreceptor (R1,R2,R3,R4) or Intermediate transfer belt (R5) after the transfer nip has transferred the marking material using residual mass sensors RI, R2, R3, R4, R5 in FIG. 7. This second measure of the amount of marking material remaining on the image bearing member (photoreceptor or ITB) is sometimes referred to as the residual image density or the RMA (Residual Mass per unit Area).

Further, FIG. 7 illustrates a controller/processor 140 that is operatively connected to the various transfer and residual sensors (TI, T2, R1-R4, etc.). The connections between the controller 140 and the various sensors are not illustrated in the drawings to avoid clutter. As would be understood by those ordinarily skilled in the art, the controller/processor 140 includes an integrated circuit logic device (e.g., at least one processor chip), a power supply, a non-transitory computer-readable data storage medium, electrical connections, physical connections, etc.

Where the current embodiment is evaluating the transfer image density at reduced transfer fields (region 2 in FIG. 5) using transfer sensors TI and T2, high field regions will have higher toner densities and will appear darker on the final image, and low field regions will appear lighter. To the contrary, where this embodiment evaluates the residual image density using residual sensors R1-R5, high field regions will have lower toner density (better transfer efficiency) and low field regions will have higher toner density. The reverse is true if the embodiment is operated in the very high field region (region 3 in FIG. 5), i.e. TI and T2 will register lower densities in high field regions and RI-R5 will register higher densities in low field regions.

Potential locations for image density sensors in a 4-color tandem marking engine are indicated in FIG. 7, although as would be understood by those ordinarily skilled in the art, any number of marking engines and sensors at different locations could be used with embodiments herein. As mentioned above, the residual image density on the image bearing member could be measured at any of the residual sensors RI, R2, R3, R4, and/or R5. The first four locations measure the residual mass on the photoreceptors after "first transfer" nips (transfer from photoreceptor to intermediate transfer belt). Residual sensor R5 measures the residual image density on the intermediate transfer belt after the "second transfer" nip (transfer from intermediate transfer belt to paper/substrate).

Figure 6:
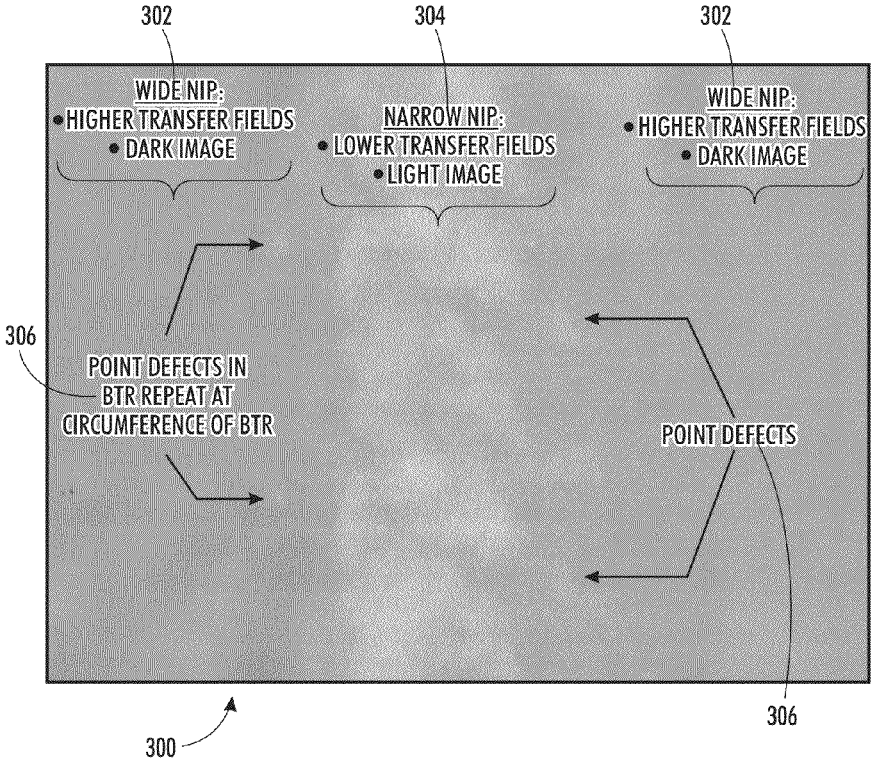
FIG. 6 is an example of a Transfer Field Uniformity Map according to an exemplary embodiment of this disclosure.

To the contrary, transfer sensor TI measures the transfer image density on the intermediate transfer belt after the first transfer nips 104. In different embodiments, additional transfer image density sensors are also employed between the first transfer nips 104. A transfer image density sensor T2 can be used to directly measure the image density of the image on the substrate (media sheet) either before or after fusing. FIG. 6 represents a transfer field uniformity map image for the magenta nip image measured at sensor location T2 after fusing.

While many sensors are discussed above, in some embodiments, a single transfer image density sensor (or sensor array) can be used (e.g., transfer sensor 12) to measure and evaluate transfer field uniformity maps for all 5 transfer nips (104, 204). Likewise a single transfer sensor TI (or sensor array) can be used to assess all of the first transfer nips 104.

To generate a transfer field uniformity map in the first nip, one of the marking engines 112 can be activated to produce an image (e.g., a yellow image) on the corresponding photoreceptor and the corresponding transfer nip is operated at, for example, a relatively lower transfer field (sloped region (2) in FIG. 5). The other first transfer devices 104 are operated at minimal electrical fields (i.e. partially disabled) to minimize retransfer scavenging of the toner from the intermediate transfer belt to the photoreceptor (because non-uniform retransfer scavenging could otherwise induce spurious non-uniformities in the transfer field uniformity map). The second transfer nip 204 would be operated at normal (relatively higher) transfer fields, and the transfer field uniformity map would be evaluated on the substrate by the transfer sensor(s) T2. Therefore, a transfer field uniformity map can be generated for any of the first transfer nips by producing an image at nip n (e.g., a full page halftone (or other) image) operating the transfer device at nip n at lower transfer field (sloped region (2) in FIG. 5). Likewise the transfer field uniformity map could be generated by operating nip n at a higher field than optimal.

Additionally, a transfer field uniformity map for the second transfer nip 204 can be generated by operating the transfer device 204 at the lower transfer field (sloped region (2) in FIG. 5) while operating the first nips 104 at the standard, higher voltage. Transfer device 204 is measured/evaluated using transfer sensor T2 (transfer image density) or residual sensor R5 (residual image density). Likewise the transfer field uniformity map could be generated by operating transfer device 204 at a higher field than optimal.

Figure 8:
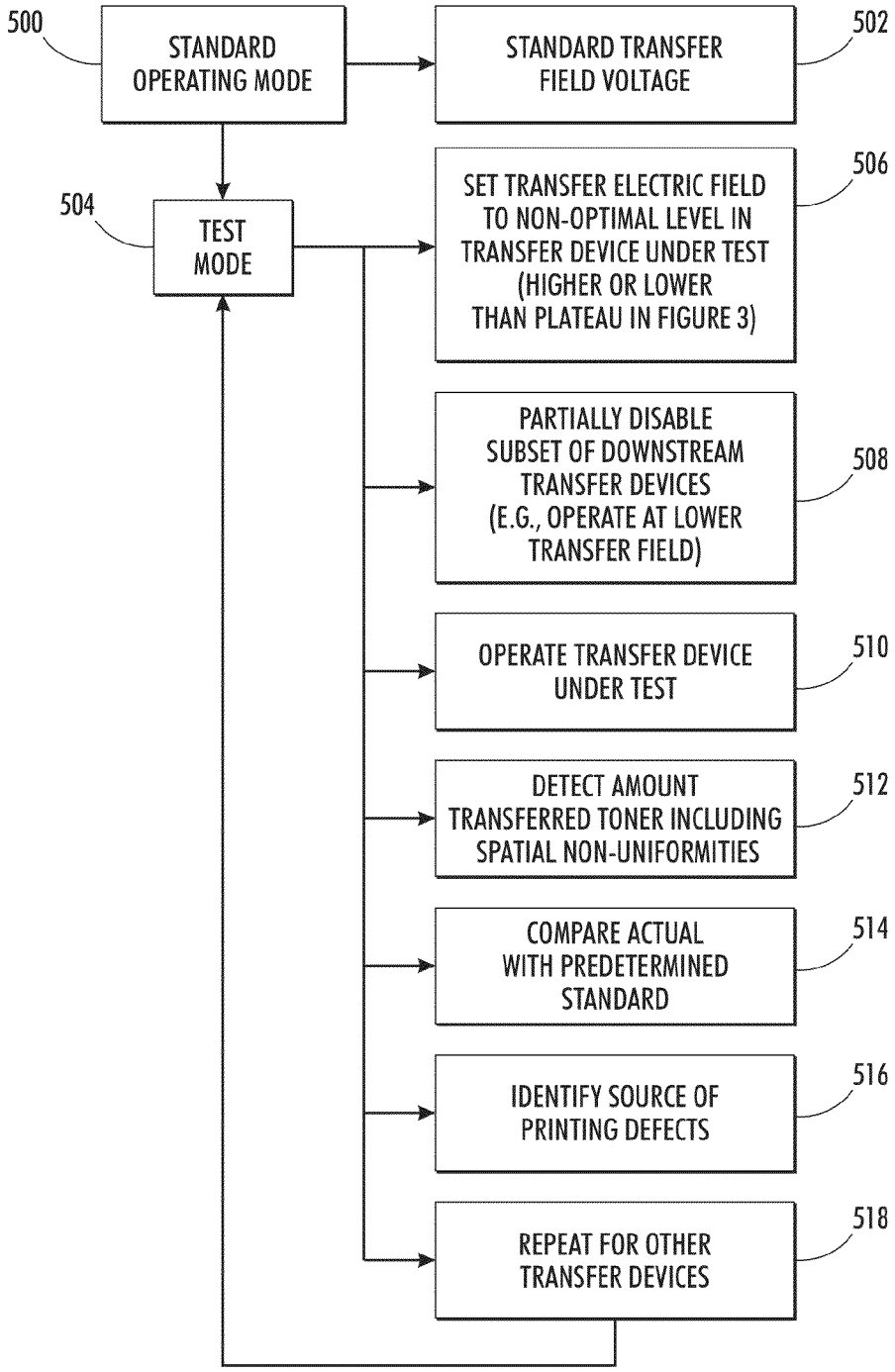
FIG. 8 is a flow chart of a process to generate a transfer field uniformity map according to an exemplary embodiment of this disclosure.

An exemplary method embodiment is shown in FIG. 8. As indicated in item 500, the embodiments herein can operate a printing device in a standard operating mode 500. While operating the printing device in the standard operating mode, the method supplies a standard transfer field to a first marking material transfer device (e.g., a transfer nip) of the printing device in item 502.

The method herein can also operate the printing device in a test mode in item 504. While operating the printing device in the test mode, the method supplies a changed, non-optional (reduced or increased) transfer field to the first marking material transfer device (506). The non-optimal transfer field is either less than or greater than the standard transfer field (e.g., 10%, 25%, 50%, etc., lower/higher transfer field). In other words, the non-optimal transfer field comprises a field sufficiently different (reduced or increased) to amplify electrical field inconsistencies (e.g., spatial inconsistencies) within the marking material transfer device.

Further, while operating the printing device in the test mode, the method can disable or partially disable operations of other marking material transfer devices of the printing device to isolate the activities of the first marking material transfer device in item 508. The method then operates the first marking material transfer device to cause the first marking material transfer device to transfer the marking material to the recipient surface in item 510. The recipient surface comprises one to which the first marking material transfer device transfers the marking material, such as a transfer belt, a sheet of print media, etc.

This process then detects the actual amount of marking material transferred to the recipient surface using, for example, an optical scanner in item 512. The method compares the actual amount of marking material transferred to a recipient surface against a predetermined standard 514. Thus, in item 516, if the spatial variation and/or actual amount of marking material transferred differs from or does not match the predetermined spatial variation standard, the method can identify the first marking material transfer device as being a potential source of printing defects.

Figure 9:
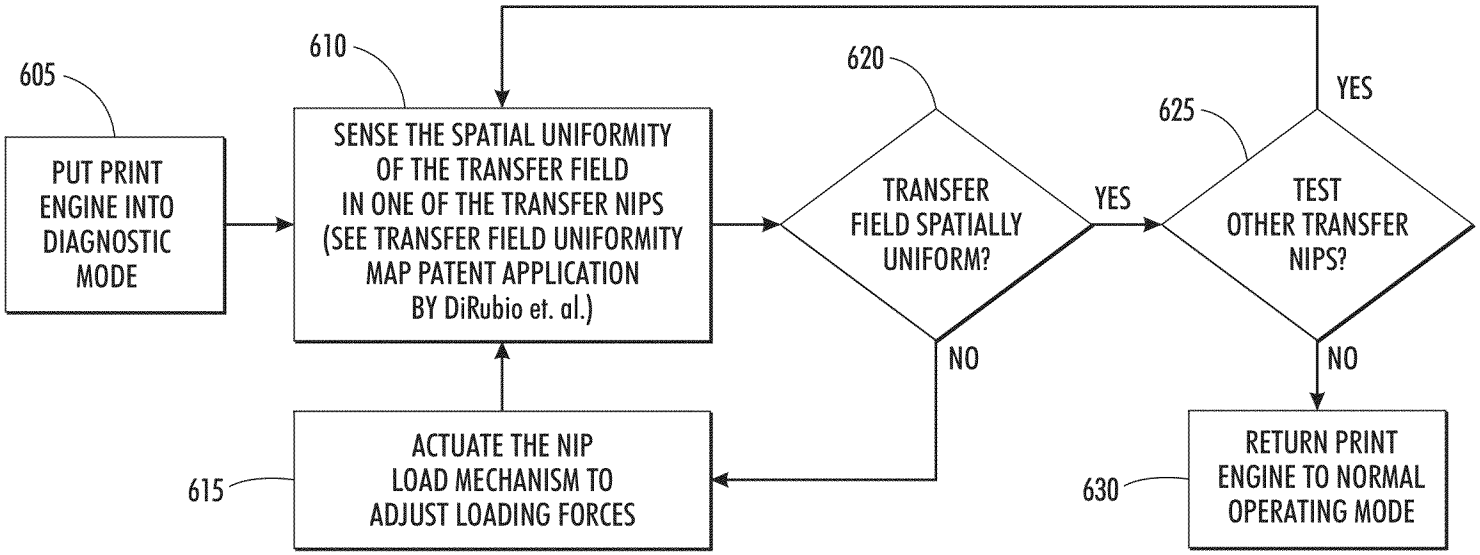
FIG. 9 is a flow chart of a closed-loop control system according to an exemplary embodiment of this disclosure.

An exemplary process of controlling a nip loading mechanism utilizing a transfer field uniformity map is now described. The process, as shown in the flowchart of FIG. 9, includes the following steps:

Put the print engine into diagnostic mode 605.

Next, sense the spatial distribution of the transfer field in one of the transfer nips 610. Preferably the sensor may consist of a full width (scan bar) array, or several point sensors located across the process, for example, several ETAC sensors. In addition, preferably the sensor(s) are located to measure the toner density on the ITB between the first transfer nips (OPC to ITB=Intermediate transfer Belt)) and second transfer (ITB to paper) nip, or on the paper exiting the fuser. If the sensor is in the latter location, the second transfer nip (ITB to paper) can also be adjusted . . . not just the first transfer nips. Using the CPU, the measured transfer field uniformity is compared to a predetermined standard 620. If the transfer field is not sufficiently uniform, use the nip loading mechanism to adjust the nip width (and therefore the transfer field) uniformity 615. If the transfer field is uniform 620, the engine can either return to normal print mode 630, or one or more of the other transfer nips could be measured and adjusted as described above.

Some benefits of the disclosed embodiments may include:

Improved macro-uniformity.

The elimination of color shifts across the print, e. g the retransfer smile defect.

The elimination of mottle variation across the print.

Gamut extension by adding colors like orange, green and/or violet.

Photo-smoothness applications that include colors like light cyan, light magenta, and grey.

Packaging applications like white underprint for labels.

More uniform prints when employing a clear overcoat.

Reduced UMR and service cost (run cost).

Improve productivity and up-time.

Potentially lower UMC due to relaxed tolerances on critical specs like the crown of the BTR or BTB.

More robust performance (insensitivity of output to uncontrolled variation in inputs).

This disclosure describes a closed-loop control strategy to insure uniform nip widths and uniform transfer fields. As described above, the transfer field uniformity is sensed using Transfer Field Uniformity Maps (TFUMs). The TFUM technique can be found described in detail in U.S. patent application Ser. No. 12/945,942, filed Nov. 15, 2010 by DiRubio et al. and entitled "TESTING TRANSFER NIPS OF PRINTING DEVICES USING TRANSFER FIELD UNIFORMITY MAPS" by DiRubio et al.

A Transfer Field Uniformity Map can be generated for any of the 5 transfer nips by:

(1) Reducing the applied transfer field until the transfer device is operating in the sloped region of the %transfer efficiency curve (operating point 2 in FIG. 2). Notably, changing the transfer field in this sensing mode is not a strict requirement.

(2) Measuring and evaluating the spatial uniformity of the density of the image transferred to the substrate, where the substrate could be the ITB (to evaluate first transfer) and/or the paper(to evaluate first and/or second transfer). This is the transferred image density or the TMA (transferred mass per unit area). See sensor locations T1 and T2 in FIG. 7.

(3) Evaluating the density of the toner remaining on the image bearing member, where the image bearing member is the OPC in one of the first transfer nips or the ITB in the second transfer nip. This is the residual image density or the RMA (Residual Mass per unit area). See sensor locations R1, R2, R3, R4, R5 in FIG. 7.

In step (2), where the transferred image density is evaluated, high field regions will have higher toner densities and will appear dark on the final image, and low field regions will appear light. In step (3), where the residual image density is evaluated, high field regions will have lower toner density (better transfer efficiency) and low field regions will have higher toner density. The example of a TFUM shown in FIG. 6 is for the magenta nip (second "first transfer" nip in FIG. 4). A long edge feed (process direction top to bottom) full page halftone print (area coverage ~60%) was generated at a low transfer field. Variation in the density of the print in the cross-process direction is due to lower fields in the center of the transfer nip relative to the inboard and outboard edges. BTR nip width variation leads to transfer field variation in the cross process direction. This field variation leads to color shifts in the cross process direction due to increased retransfer scavenging to downstream first transfer nips (nips 1-4 in FIG. 7). The higher fields induce more air breakdown within the toner pile, which in turn generated more wrong sign toner that retransfers back to the photoreceptors in the downstream nips. Field variation in the process direction that repeats at a distance equal to the circumference of the biased transfer roller indicates non-uniformity in the electrical or mechanical properties of the BTR. Several low field defects in the sample TFUM repeat at this spatial frequency.

As previously discussed, potential locations for image density sensors in a 4-color tandem engine are indicated in FIG. 7. The residual image density on the image bearing member could be measured at any of the locations R1, R2, R3, R4, and/or R5. The first four locations measure the residual mass on the photoreceptors after "first transfer" nips (transfer from OPC to ITB). Location R5 measures the Residual Image density on the ITB after the "second transfer" nip (transfer from ITB to paper/substrate). Location Ti measures the transferred image density on the ITB after the first transfer nips (nips 1-4). In principal, additional transferred image density sensors could also be employed between the first transfer nips (1-4). A transferred image density sensor could be located at position T2 to directly measure the image density of the image on the substrate either before or (preferably) after fusing. FIG. 6 represents a TFUM image for nip 2 image measured at sensor location T2.

A single transferred image density sensor (or sensor array) located at position T2 would be adequate to measure and evaluate TFUMs for all 5 transfer nips. Likewise a single sensor (or sensor array) located at poison T1 would be adequate to assess all of the first transfer nips (nips 1-4). Assuming the color order is Y, M, C, K for nips 1-4, to evaluate the TFUM in the first nip, a yellow image can be generated on the first photoreceptor and the first transfer nip can be operated at a low transfer field (sloped region of FIG. 2). The downstream first transfer devices (nips 2, 3, 4) can be operated at minimal fields to minimize retransfer scavenging of the toner from the ITB to the OPC. Non-uniform retransfer scavenging could induce spurious non-uniformities in the TFUM. The second transfer nip (nip 5) would be operated at normal transfer fields, and the TFUM would be evaluated on the substrate by the sensor(s) at T2

Likewise, a TFUM for any of the first transfer nips can be generated by:

(1) Generating an image at nip n (preferably a full page halftone, but other types of image content may be utilized).

(2) Operating the transfer device at nip n at low transfer field (sloped region 2 in FIG. 5).

(3) Optionally operating the downstream first transfer nips at very low (minimal) fields to reduce retransfer scavenging.

If the nip pressure in downstream nips could also be reduced, then retransfer scavenging can be further minimized.

(3) Operating nip 5 at a normal transfer field to faithfully transfer the TFUM to the substrate.

(4) Sensing the TFUM at position 12 to determine the transfer field uniformity.

A TFUM for the second transfer nip (Nip 5) can be generated by operating the transfer device at nip 5 at low transfer field (sloped region 2 in FIG. 2) and sensing the TFUM at locations T2 (transferred image density) or R5 (residual image density).

There are several sensor options for sensing transfer field uniformity maps (TFUMs). Full width array (FWA) optical imaging bars would provide data that could be used to find spatially small transfer field variations like the repetitive point defects illustrated in FIG. 6. A cheaper array of two or more point sensors located at different points in the cross-process direction can be used to detect larger scale cross-process field variation, like that expected from retransfer smile (see FIG. 6). The retransfer smile defect (color variation in the cross-process direction) is caused by cross-process transfer field variation (see discussion prior to FIG. 6). Point image/toner density sensors are already routinely used in color xerographic engines to monitor the TMA (transferred mass per unit Area) at position T1. These sensors include the ETACS (Enhanced Toner Area Coverage Sensors) used by Xerox Corporation and ADC sensors used by Fuji Xerox engines.

Figure 10:
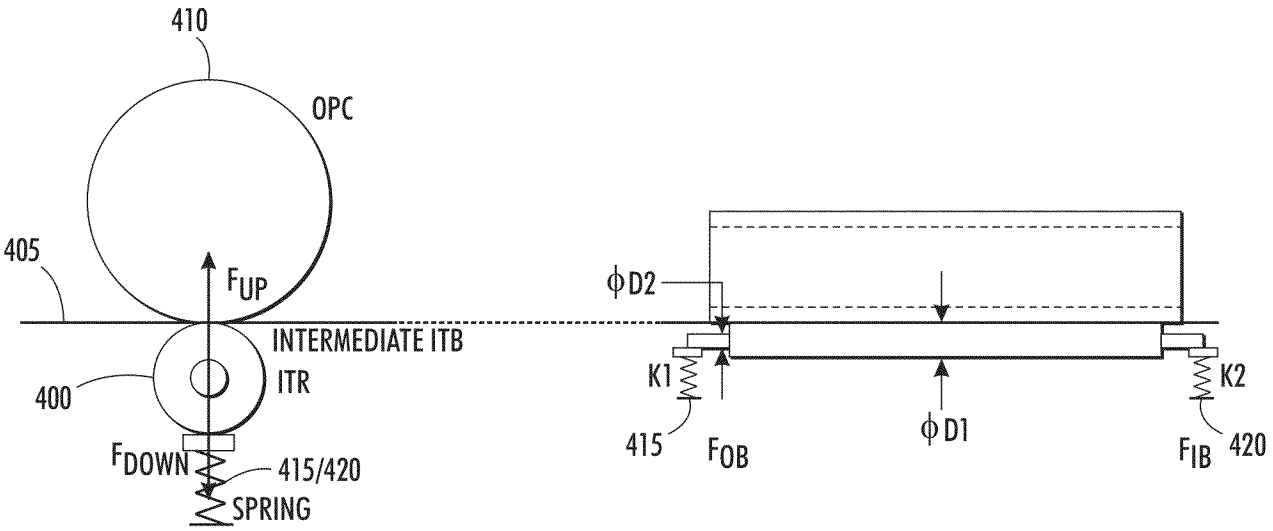
FIG. 10 illustrates an exemplary embodiment of an ITR (Image Transfer Roll) and associated loading mechanism.

An ITR loading mechanism according to an exemplary embodiment of this disclosure is illustrated in FIG. 10. The ITR consists of an elastomer material mounted on a stiff metallic shaft. The Biased Image Transfer Roller (ITR) 400 is loaded (K1 and K2) against the back of the Intermediate Image Transfer Belt (ITB) 405 which is in contact with the photoreceptor (OPC) 410. The ITR load is provided by a mechanism utilizing inboard and outboard springs 415 and 420 with spring constants K1 and K2. The diameter of the ITR elastomer is ϕD1 and the diameter of the central shaft is ϕD2 in the FIG. The inboard and outboard springs are controllably compressed to deliver a predetermined force/load that insures intimate contact between the image bearing member carrying the toner and the image receiving member in the transfer nip (e.g. the photoreceptor 410 and the ITB 405 in FIG. 10). In a typical first transfer nip (toner transfer from photoreceptor to ITB) the nominal force is chosen to insure a target nip pressure that is typically around 0.5 to 1.5 pounds per square inch (PSI). In a second transfer nip (toner transfer from ITB to substrate/media or photoreceptor to substrate/media) higher pressures (2-10 PSI or greater) may be required to insure intimate contact between the surfaces. The closed loop control algorithm (FIG. 9) senses the image transfer field uniformity and adjusts the force/load ($F_{IB}$ and $F_{OB}$) by adjusting/actuating the spring (415 and 420) compression to insure that the field is spatially uniform. The actuation of the spring (415 & 420) compression may be achieved using a cam driven by a control motor or some other similar automated mechanism. The actuation would adjust the compression of each spring independently. As FIG. 3 illustrates, in order to achieve this uniform field the nip pressure must itself be uniform across the process. The elastomer is typically crowned so that the center of the roll has a larger diameter than the edges (see for example U.S. patent application Ser. No. 12/868,936). This crown, along with the automated control of the force/load on each spring and the elastic modulus of the ITR elastomer insures that a uniform nip pressure can be achieved within the acceptable range of target nip pressures.

It should be understood that the elastomer material may or may not be centered about the metallic shaft. In the circumstance where the elastomer material is not centered about the shaft, the forces on each end need to be somewhat unbalanced to insure a uniform nip width in the cross process direction. Otherwise, the nip will be wider on the end of the elastomer material with the longer shaft extension beyond the elastomer material, relative to the end of the elastomer material with the shorter shaft extension beyond the elastomer material.

Figure 11:
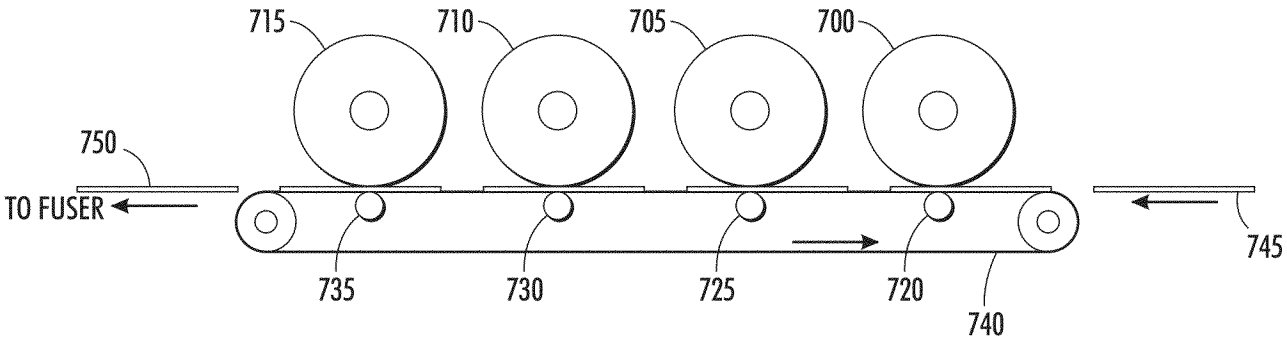
FIG. 11 illustrates an exemplary embodiment of a four color "direct to paper" image marking apparatus according to an exemplary embodiment of this disclosure.

Referring to FIG. 11, illustrated is another exemplary embodiment of an image marking apparatus according to an exemplary embodiment of this disclosure. In contrast to the other image marking apparatus discussed hereto, this apparatus includes an architecture providing direct marking, i.e. transfer, of a media substrate from a photoreceptor 700, 705, 710 and 715 to a media substrate. As illustrated, a media substrate 745 is escorted by a belt 740 which advances the media substrate to a series of image transfer stations, the first image transfer station including PR drum 700 and BTR 720. The second image transfer station including PR drum 705 and BTR 725. The third image transfer station including PR drum 710 and BTR 730. The fourth image transfer station including PR drum 715 and BTR 735.

In operation, each image transfer station is associated with a distinct toner color, for example, Cyan, Magenta, Yellow and Black. To transfer an image from a respective PR drum to a media substrate, a closed-loop control system as described with reference to FIGS. 1 through 10 is utilized, whereby a respective image transfer nip, including a PR drum and BTR, is electrically biased to generate an image transfer field across the image transfer nip, and one or more forces are applied to the BTR to control the spatial uniformity associated with the image transfer nip.

Additional Comments Regarding the Use of Transfer Field Uniformity Maps to Improve Marking Performance.

Automated Transfer field Uniformity Maps can be used to diagnose a root cause of print quality defects or sub-optimal transfer performance in a marking engine. An example of a TFUM analysis is as follows.

(1) Trigger TFUM analysis: A trigger initiates an automated TFUM analysis, e.g. a print quality defect might be detected, triggering the analysis.

Manual trigger: The trigger could be initiated by a customer/user, and service engineer, or a system test engineer on the manufacturing line.

Automated trigger: This trigger could be initiated by a counter (e.g., print count), or an internal machine sensor (e.g. Temp, RH), or a detected print quality defect (e.g., detected with a full width array image bar).

(2) Enter diagnostic mode: The print engine goes into a diagnostic mode.

(3) Sense Transfer Field Uniformity Map (TFUM): A TFUM is automatically generated for each transfer nip. In the case of a four color tandem IBT (Intermediate Belt Architecture) this would be up to 5 TFUMS, one for each of the nips indicated in FIG. 7.

(4) Analyze and diagnose transfer performance: The TFUM data is collected by the sensors and analyzed by a software routine to identify which, if any, of the transfer nips is performing sub-optimally (e.g. generating a PQ defect).

(5) Action option 1, improve transfer performance: If the analysis indicates a transfer nip is performing sub-optimally, an action can be taken to improve transfer performance. Once the action is complete, steps 3 and 4 may be repeated to determine if the actions were successful.

"Closed-loop actions": The TFUM sensing might be employed as a sensor within a closed-loop feedback system.

(6) Action option 2, continue diagnosis: If the analysis indicates that transfer nips are performing adequately, and there is a print quality defect that still needs to be diagnosed, then transfer can be ruled out as the root cause and other diagnostic routines can be initiated to identify the source (component or subsystem) of the print quality defect(s).

This disclosure provides the ability to measure the spatial uniformity of the transfer field in the nip using transfer field uniformity maps.

This disclosure also provides methods and systems to improve nip width uniformity by varying the load on the transfer device that brings the image receiving surface (e.g. ITB) into contact with the image bearing surface (e.g. OPC).

Color shifts between the center of the image, and the inboard and outboard edges were observed in prints generated by a 6-color tandem engine under development. This defect was associated with enhanced retransfer scavenging, which is particularly bad for two or more layer images that travel through two or more downstream (retransfer) first transfer nips. Nip width measurements were used to demonstrate that the first transfer nips were wider in the inboard and outboard regions of the image. Transfer field modeling indicated that wider nips should lead to higher fields, and enhanced retransfer scavenging. The measured TFUMs were used to validate that the transfer fields were, in fact, higher on the inboard and outboard edges, thereby validating that we understood the root cause mechanism. In addition, demonstrated is a nearly perfect correlation between nip width measurements and the TFUMS. Therefore we demonstrated a TFUM could be used as an accurate measure of nip width uniformity, and that uniform nips are required to eliminate the retransfer smile macro-uniformity defect.

The automated closed-loop TFUM routine can be used in manufacturing to insure that all of the transfer nips have sufficiently uniform nips. If the closed-loop routine was not successful, then parts could be replaced.

The automated closed-loop TFUM routine can identify which, if any, of the transfer nips needed further adjustment or need to have the BTR replaced.

The automated closed-loop TFUM routing can identify and automatically adjust transfer nips with poor nip width uniformity. Alternately, if the transfer field uniformity is still out of spec., the machine can initiate a service call through remote diagnostics that would identify exactly which nips require attention. The engine can also send an error or warning message the front panel of the print engine to warn the customer to take action.

Described hereto is a nip width closed-loop control system within the context of a tandem IBT marking architecture which has focused on the mitigation of the retransfer smile defect. Other embodiments include the following:

This disclosed control system can be used within a larger automated or semi-automated diagnostic routine to identify the subsystem(s) responsible for specific print quality defects.

This disclosed control system can be used with any kind of transfer nip technology, including: conformable biased transfer nips (Biased Transfer Rollers=BTRs, Biased Transfer Belts=BTBs, etc.), Corotron and Dicorotron transfer nips, Corotron/Dicorotron transfer nip employing Transfer Assist Blades, etc.

The disclosed technique can help identify and mitigate a host of print quality defects associated with non-uniform transfer including: Retransfer smile, materials properties variation with a biased transfer member (BTRs or BTBs), hot spots on the coronodes of corotrons and dicorotrons, Coronode arcing to shields, Transfer induced mottle, transfer induced toner disturbances due to arcing (e.g. the Maruhanko defect and fireworks), etc, It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

Glossary

ITR=Image Transfer Roller. BTR=Biased Transfer Roller (an electrically biased ITR).

A metal shaft surrounded by a conformable, tuned-conductivity elastomer.

BTB=Biased transfer Belt.

This consists of a belt, often conformable, entrained on two or more rollers. One or more of the rollers may be a BTR.

ITB=Intermediate Transfer Belt.

IBT=Intermediate Belt Transfer, a marking architecture.

OPC=Organic Photoreceptor, a type of photoreceptor. Notably, OPC is used here interchangeably with the term "photoreceptor".

TFUM=Transfer Field Uniformity Map.

First transfer=the process of building the image on an ITB in transfer nips.

Second transfer=the process of transferring the unfused image from the ITB to paper.

UMR=unscheduled maintenance rate.

UMC=Unit Manufacturing Cost.

Substrate=includes, but is not limited to, media substrates such as cut sheet, media web, and intermediate image transfer belts.

What is claimed is:

1. A method of marking an image on a substrate using an image transfer printing apparatus including a photoreceptor surface; an exposure station operatively associated with the photoreceptor surface; a developer system operatively associated with the photoreceptor surface; and a substrate; an image transfer nip operatively associated with transferring an image from the photoreceptor surface to the substrate, the method comprising:

a) forming an electrostatic image on the photoreceptor surface representative of the image to be marked on the substrate using the exposure system;

b) developing the electrostatic image on the photoreceptor surface with toner material using the developer system to generate a developed image; and c) transferring the developed image from the photoreceptor surface to the substrate by electrically biasing the image transfer nip using a standard operating voltage to generate an image transfer field across the image transfer nip and applying two or more standard operating mechanical forces to the image transfer nip to control a spatial uniformity associated with the image transfer nip, the two or more standard operating mechanical forces determined by executing a closed-loop control system during a test mode configured to generate a transfer field uniformity map associated with the image transfer nip to determine the two or more standard operating mechanical forces required to generate a substantially uniform image transfer field across the image transfer nip, wherein the closed-loop control system is configured to generate the transfer field uniformity map using a test mode two or more mechanical forces by sensing the uniformity of the image transfer field while electrically biasing the image transfer nip using a test mode voltage which is lower than the standard operating voltage, comparing the generated transfer field uniformity map to a predetermined transfer field uniformity standard and adjusting one or more of the test mode two or more mechanical forces to provide a more uniform image nip width if the transfer field uniformity map represents a uniformity less than the transfer field uniformity standard, the adjusted test mode two or more mechanical forces providing the two or more standard operating mechanical forces.

2. The method of marking an image on a substrate according to claim 1, wherein the photoreceptor surface is a photoreceptor drum.

3. The method of marking an image on a substrate according to claim 2, wherein the substrate is one of a media substrate and an intermediate image transfer surface.

4. The method of marking an image on a substrate according to claim 3, wherein the image transfer nip comprises one or more of an Image Transfer Roll and an Image Transfer Belt.

5. The method of marking an image on a substrate according to claim 4, wherein the image transfer nip comprises an Image Transfer Roll which is crowned.

6. The method of marking an image on a substrate according to claim 1, the printing apparatus including one or more sensors to measure toner density on one or more of the media substrate and the photoreceptor surface.

7. The method of marking an image on a substrate according to claim 6, wherein the sensors are one or more of a FWA and point sensors.

8. The method of marking an image on a substrate according to claim 1, wherein the image transfer nip includes a conformable roll.

9. The method of marking an image on a substrate according to claim 1, the printing apparatus including one or more sensors to measure the residual image density on the photoreceptor surface.

10. An image marking apparatus comprising:

a substrate;

an image marking device operatively associated with transferring of an image to the substrate, the image marking device associated with a distinct toner material colorant; and an image transfer nip operatively associated with transferring an image to the substrate, the image transfer nip configured to transfer the image to the substrate by electrically biasing the image transfer nip using a standard operating voltage to generate an image transfer field across the image transfer nip and applying two or more standard operating mechanical forces to the image transfer nip to control a spatial uniformity associated with the image transfer nip, the two or more standard operating mechanical forces determined by executing a closed-loop control system during a test mode configured to generate a transfer field uniformity map associated with the imaqe transfer nip to determine the two or more standard operating mechanical forces required to generate a substantially uniform image transfer field across the image transfer nip, wherein the closed-loop control system is configured to generate the transfer field uniformity map using a test mode two or more mechanical forces by sensing the uniformity of the image transfer field while electrically biasing the image transfer nip using a test mode voltage which is lower than the standard operating voltage, comparing the generated transfer field uniformity map to a predetermined transfer field uniformity standard and adjusting one or more of the test mode two or more mechanical forces to provide a more uniform image nip width if the transfer field uniformity map represents a uniformity less than the transfer field uniformity standard, the adjusted test mode two or more mechanical forces providing the two or more standard operating mechanical forces.

11. The image marking apparatus according to claim 10, wherein each image marking device comprises:

a photoreceptor drum;

an exposure station operatively associated with the photoreceptor drum and configured to form an electrostatic image on the photoreceptor drum; and a developer system operatively associated with the photoreceptor drum and configured to develop the electrostatic image with a toner material.

12. The image marking apparatus according to claim 10, further comprising:

one or more sensors to measure toner density on one or more of the substrate, the media substrate and the photoreceptor surface.

13. The image marking apparatus according to claim 12, wherein the sensors are one or more of a FWA and point sensors.

14. The image marking apparatus according to claim 10, wherein the image transfer nip includes a crowned conformable roll.

15. The image marking apparatus according to claim 10, further comprising:

one or more sensors to measure the residual image density on the photoreceptor surface.

16. An image marking apparatus comprising:

an intermediate image transfer belt;

an image marking device operatively associated with transferring of an image to the intermediate image transfer belt, the image marking device associated with a distinct toner material colorant;

an image transfer nip operatively associated with transferring an image to the intermediate image transfer belt, the image transfer nip configured to transfer the image to the intermediate image transfer belt by electrically biasing the image transfer nip using a standard operating voltage to generate an image transfer field across the image transfer nip and applying two or more standard operating mechanical forces to the image transfer nip to control a spatial uniformity associated with the image transfer nip, the two or more standard operating mechanical forces determined by executing a closed-loop control system during a test mode configured to generate a transfer field uniformity map associated with the image transfer nip to determine the two or more standard operating mechanical forces required to generate a substantially uniform image transfer field across the image transfer nip, wherein the closed-loop control system is configured to generate the transfer field uniformity map using a test mode two or more mechanical forces by sensing the uniformity of the image transfer field while electrically biasing the image transfer nip using a test mode voltage which is lower than the standard operating voltage, comparing the generated transfer field uniformity map to a predetermined transfer field uniformity standard and adjusting one or more of the test mode two or more mechanical forces to provide a more uniform image nip width if the transfer field uniformity map represents a uniformity less than the transfer field uniformity standard, the adjusted test mode two or more mechanical forces providing the two or more standard operating mechanical forces; and an image transfer station operatively associated with the transfer of the image from the intermediate image transfer belt to the media substrate.

17. The image marking apparatus according to claim 16, wherein the image marking device comprises:

a photoreceptor drum;

an exposure station operatively associated with the photoreceptor drum and configured to form an electrostatic image on the photoreceptor drum; and a developer system operatively associated with the photoreceptor drum and configured to develop the electrostatic image with a toner material.

18. The image marking apparatus according to claim 16, further comprising:

one or more sensors to measure toner density on one or more of the intermediate image transfer surface, the media substrate and the photoreceptor surface.

19. The image marking apparatus according to claim 18, wherein the sensors are one or more of a FWA and point sensors.

20. The image marking apparatus according to claim 16, wherein the image transfer nip includes a conformable roll.

21. The image marking apparatus according to claim 16, further comprising:

one or more sensors to measure the residual image density on the photoreceptor surface.

22. An image marking apparatus comprising:

an intermediate transfer belt;

an image marking device operatively associated with transferring of an image to the intermediate image transfer belt, the image marking device associated with a distinct toner material colorant; and an image transfer station operatively associated with the transfer of the image from the intermediate image transfer belt to the media substrate, the image transfer station including an image transfer nip configured to transfer the image from the intermediate image transfer belt by electrically biasing the image transfer nip using a standard operating voltage to generate an image transfer field across the image transfer nip and applying two or more standard operating mechanical forces to the image transfer nip to control a spatial uniformity associated with the image transfer nip, the two or more standard operating mechanical forces determined by executing a closed-loop control system during a test mode configured to generate a transfer field uniformity map associated with the image transfer nip to determine the two or more standard operating mechanical forces required to generate a substantially uniform image transfer field across the image transfer nip, wherein the closed-loop control system is configured to generate the transfer field uniformity map using a test mode two or more mechanical forces by sensing the uniformity of the image transfer field while electrically biasing the image transfer nip using a test mode voltage which is lower than the standard operating voltage, comparing the generated transfer field uniformity map to a predetermined transfer field uniformity standard and adjusting one or more of the test mode two or more mechanical forces to provide a more uniform image nip width if the transfer field uniformity map represents a uniformity less than the transfer field uniformity standard, the adjusted test mode two or more mechanical forces providing the two or more standard operating mechanical forces.

23. The image marking apparatus according to claim 22, wherein the image marking device comprises:

a photoreceptor drum;

an exposure station operatively associated with the photoreceptor drum and configured to form an electrostatic image on the photoreceptor drum; and a developer system operatively associated with the photoreceptor drum and configured to develop the electrostatic image with a toner material.

24. The image marking apparatus according to claim 22, further comprising:

one or more sensors to measure toner density on one or more of the intermediate image transfer surface, the media substrate and the photoreceptor surface.

25. The image marking apparatus according to claim 24, wherein the sensors are one or more of a FWA and point sensors.

26. The image marking apparatus according to claim 22, wherein the image transfer nip includes a conformable roll.

* * * * *